United States Patent [19]

Kawasaki et al.

[11] Patent Number: 4,912,079

[45] Date of Patent: Mar. 27, 1990

[54] THERMOSENSITIVE RECORDING MATERIAL

[75] Inventors: Kanjirou Kawasaki, Numazu; Hiroaki Inoue, Fuji; Tomohisa Kakuda; Yasutomo Mori, both of Numazu, all of Japan

[73] Assignee: Ricoh Company, Ltd., Tokyo, Japan

[21] Appl. No.: 199,866

[22] Filed: May 27, 1988

[30] Foreign Application Priority Data

May 30, 1987 [JP] Japan ..... 62-136052

[51] Int. Cl.[4] ..... B41M 5/18

[52] U.S. Cl. ..... 503/200; 427/152; 428/304.4; 428/313.3; 428/313.8; 428/318.4; 428/334; 428/335; 428/336; 428/913; 503/207; 503/226

[58] Field of Search ..... 427/150–152; 428/913, 304.4, 313.3, 313.5, 318.4, 334–336, 914; 503/200, 207, 226

[56] References Cited

FOREIGN PATENT DOCUMENTS 59-225987 12/1984 Japan ..... 503/226

*Primary Examiner*—Bruce H. Hess

*Attorney, Agent, or Firm*—Oblon, Spivak, McClelland, Maier & Neustadt

[57] ABSTRACT

A thermosensitive recording material is disclosed, which comprises a support, an intermediate layer having a voidage ranging from 50% to 95% and a thickness of 3 μm to 100 μm, and a thermosensitive coloring layer, which layers are successively formed on the intermediate layer.

4 Claims, No Drawings

THERMOSENSITIVE RECORDING MATERIAL

BACKGROUND OF THE INVENTION

The present invention relates to a thermosensitive recording material, and more particularly to an improved thermosensitive recording material comprising a support, an intermediate layer including minute voids formed on the support, and a thermosensitive coloring layer formed on the intermediate layer.

It is conventionally known that a colorless or light-colored coloring leuco dye reacts with a color developer such as an organic acidic material to be colored upon application of heat thereto until the leuco dye and the color developer are fused. Thermosensitive recording materials utilizing this coloring reaction are conventionally known as are disclosed, for instance, in Japanese Patent Publication Nos. 43-4160 and 45-14039.

Recently, those thermosensitive recording sheets have been employed in a variety of fields, for instance, for use with recorders for measurement instruments, terminal printers for computers, facsimile apparatus, automatic ticket vending apparatus, and bar code readers.

In accordance with recent remarkable improvements in the application of the above-mentioned recording apparatus to a variety of new fields and the performance thereof, there is a great demand for thermosensitive recording sheets which can complement those improved apparatus. More specifically, there are demanded thermosensitive recording sheets capable of yielding sharp images with high density at a small amount of thermal energy with the advance of the thermal head speed. In addition, thermosensitive recording sheets are required to satisfy the sufficient thermal head matching properties such as not forming any dust from the recording material in the course of thermosensitive recording by use of the thermal head which comes into contact with the surface of the thermosensitive recording material and not sticking to the thermal head.

Color development on the thermosensitive recording sheet can be attained by the melting of a coloring leuco dye or a color developer or both of them and the reaction of the two to induce a color in the leuco dye under the application of thermal energy from the thermal head.

As a method of increasing the thermal coloring sensitivity of the thermosensitive recording material, there is widely known a method of adding to the thermosensitive recording material a thermofusible material which melts at a temperature lower than the melting points of the employed leuco dye and the color developer and is capable of dissolving therein the leuco dye and color developer when melted.

A variety of thermofusible materials for use in this method have been proposed, for example, nitrogen-containing compounds such as acetamide, stearamide, m-nitroaniline, and phthalic acid dinitrile in Japanese Laid-Open Patent Application No. 49-34842; acetoacetic anilide in Japanese Laid-Open Patent Application No. 52-106746; and alkylated biphenyl alkanes in Japanese Laid-Open Patent Application No. 53-39139.

However, in accordance with the recent development of a high speed thermal facsimile apparatus, it has become a common practice to energize and drive a thermal head at high speed. Under such circumstances, there is a problem of undesirable color development that the background of a thermosensitive recording sheet is also colored due to the build-up of thermal energy in the thermal head and therearound in the course of repetition of high speed thermosensitive recording. Therefore it is one of the most important subjects to be cleared in order to enhance the dynamic thermal coloring sensitivity in the conventional thermosensitive recording materials, without decreasing the coloring initiation temperature thereof. In the conventional thermosensitive recording materials, the dynamic thermal coloring sensitivity cannot be increased unless a large amount of the above-mentioned thermofusible compounds is added, although the static thermal coloring sensitivity can be increased to some extent by the addition of the thermofusible compounds. However, when a large amount of the thermofusible materials is employed, the sticking and dust-adhesion problems occur in the course of thermal recording by a thermal head. Further, when the melting points of the thermofusible compounds are extremely low, the preservability of the thermosensitive recording sheets is significantly degraded so that the fogging of the background of the recording material occurs during the storage thereof.

For the purpose of advancing the dynamic thermal coloring sensitivity of the recording material, there have been proposed a method of improving the smoothness of the thermosensitive coloring layer, and a method of increasing the concentration of the coloring components by decreasing the relative amounts of components which do not contribute to the coloring reaction of the thermosensitive recording material, such as fillers and binder agents.

The method of improving the smoothness of the thermosensitive coloring layer is usually carried out without difficulty by use of a super calender. However, this method has the shortcomings that the background of the thermosensitive coloring layer is colored during the calendering process and the surface of the thermosensitive coloring layer becomes so glossy that the appearance of the recording material is impaired.

To the thermosensitive coloring layer, a filler such as calcium carbonate, clay, and urea-formaldehyde resin may be added to maintain the whiteness of the background of the coloring layer and to prevent the sticking and dust adhesion problems during the thermosensitive recording using a thermal head. Further a water-soluble binder agent may be added to the thermosensitive coloring layer to firmly bind the coloring components and other additives of the thermosensitive coloring layer to a support. When the amount of such a filler and a water-soluble binder agent is reduced, the desired properties for the thermosensitive recording material cannot be obtained.

Under such circumstances, a thermosensitive recording material has been proposed, in which an intermediate layer including numerous minute voids is interposed between a support and a thermosensitive coloring layer for the purpose of effectively utilizing the thermal energy provided by a thermal head. For example, Japanese Laid-Open Patent Application No. 59-5093 discloses a thermosensitive recording material including a layer comprising as the main component microballoon-like particles, which is interposed between a support and a thermosensitive coloring layer. Japanese Laid-Open Patent Application No. 59-171685 discloses a thermosensitive recording material wherein a layer containing a blowing agent and a thermoplastic polymeric material is formed on a support, which layer becomes a heat insulating layer when it is heated and a blowing gas is produced from the blowing agent. Further Japanese Laid-Open Patent Application No. 59-225987 discloses a thermosensitive recording material comprising a support, an expanded layer which is formed by coating an expandable plastic on the support and expanding the plastic with application of heat thereto, an undercoat layer comprising a filler and a binder agent, and a thermosensitive coloring layer, which layers are successively overlaid on the support in this order.

However, these thermosensitive recording materials have the drawbacks that heat insulating layer does not have satisfactory flexibility and heat insulating properties, and the close contact between a thermal head and a thermosensitive recording sheet is not sufficient.

SUMMARY OF THE INVENTION

It is therefore an object of the present invention to provide a thermosensitive recording material having high dynamic thermal coloring sensitivity, which material is capable of yielding sharp images with high density by application of a small amount of thermal energy thereto, with other necessary performances for the thermosensitive recording material, such as good thermal head matching performance without the problem of sticking between the thermal head and the recording material are maintained unchanged.

Another object of the present invention is to provide a thermosensitive recording material which does not have the shortcoming that the thermosensitive recording material peels off the support.

A further object of the present invention is to provide a thermosensitive recording material which is suitable for use in the form of a roll sheet.

The above objects of the present invention can be achieved by a thermosensitive recording material comprising a support, an intermediate layer including minute voids formed on the support, having a voidage of 50% to 95%, and a thickness of 3 μm to 100 μm, and a thermosensitive coloring layer formed on the intermediate layer.

DETAILED DESCRIPTION OF THE PREFERRED EMBODIMENTS

The thermosensitive recording material according to the present invention comprises a support, an intermediate layer including voids, having a voidage of 50% to 95% and a thickness of 3 μm to 100 μm, formed on the support, and a thermosensitive coloring layer formed on the intermediate layer. In the present invention, because of the use of the intermediate layer having a low density, with the above mentioned voidage and the thickness, in the above structure, high heat insulating effect is obtained, so that the thermal energy provided by a thermal head can be effectively absorbed in the thermosensitive coloring layer.

In the present invention, the voidage of the intermediate layer is in the range of 50% to 95% as mentioned above. When the voidage is less than 50%, the heat insulating performance of the intermediate layer is insufficient for effective use of the thermal energy provided by the thermal head for image formation, and furthermore, the thermal head does not comes into close contact with the thermosensitive recording layer of the recording material. On the other hand, when the voidage of the intermediate layer is more than 95%, the thermosensitive coloring layer is apt to be peeled off the intermediate layer.

In the present invention, the thickness of the intermediate layer is in the range of 3 μm to 100 μm, preferably in the range of 3 μm to 50 μm, and more preferably in the range of 5 μm to 30 μm.

When the thickness of the intermediate layer is less than 3 μm, the heat insulating performance of the intermediate layer is decreased, while when the thickness of the intermediate layer exceeds 100 μm, it becomes difficult to work the thermosensitive recording material into a roll.

When the intermediate layer of the thermosensitive recording layer for use in the present invention has a voidage ranging from 50% to 95% and a thickness ranging from 3 μm to 100 μm, more preferably 3 μm to 50 μm, the degree of close contact between a thermal head and the thermosensitive recording sheet is so remarkably improved that printing performance is significantly improved. In addition, the heat insulating performance is sufficiently high and the thermosensitive recording material can be worked into a roll without difficulty.

In the present invention, the voidage of the intermediate layer is defined as a percentage of the whole volume of the intermediate layer, which is obtained by subtracting the volume of the entire solid portions of the intermediate layer from the whole volume of the intermediate layer.

The voidage is obtained in practice by taking an enlarged photograph of a cross section of the thermosensitive recording material (for instance, by an optical microscope or by an electron microscope) and determining the whole area occupied by the solid materials in the cross section of the intermediate layer and the entire cross section of the intermediate layer. The above-mentioned area occupied by the solid materials can be actually measured, but the area can be much more easily determined by a commercially available device for analyzing images by which the area is determined by extracting the boundaries of the portions of the solid materials in the cross section.

The intermediate layer including minute voids for use in the present invention can be formed, for example, by any of the following three methods: (1) a method of coating inorganic minute void particles or minute void plastic filler particle, each particle having a voidage of 50% or more, onto a support; (2) a method of forming an intermediate layer on a support, which intermediate layer contains an expandable plastic filler comprising shells made of a thermoplastic material and a solvent having a low boiling point which is contained in the shells, followed by applying heat to the intermediate layer and expanding the same to the extent that the above-mentioned voidage is obtained; and (3) a method of providing an intermediate layer containing (i) a blowing agent from which a gas such as $CO_2$, $N_2$, $NH_3$, and $O_2$ is generated upon application of heat and (ii) a thermoplastic polymeric material on a support, and applying heat the intermediate layer to form an intermediate layer with a cell-like structure, having a large voidage.

In the above methods, when necessary, the voidage can be adjusted as desired by subjecting the intermediate layer to calendering.

In the above-mentioned method (1), as the inorganic minute void particles, conventional inorganic void particles can be employed, such as minute void particles made of glass and minute void particles made of ceramics, more specifically minute void particles made of borosilicate glass and minute void particles made of aluminosilicate.

The plastic fillers employed in the above-mentioned methods (2) and (3) are made of expandable or unexpanded plastic filler particles in the form of minute void particles, which comprise a thermoplastic material serving as a shell and a low boiling point solvent placed therein. As such plastic fillers, a variety of conventional materials, known in the field of thermosensitive recording material, can be employed. As the thermoplastic resin for the shell of such plastic fillers, polystyrene, polyvinyl chloride, polyvinylidene chloride, polyvinyl acetate, polyacrylic acid ester, polyacrylonitrile, polybutadiene and copolymers of the above can be employed.

As the low boiling point solvent placed in the shell, propane and isobutane can be generally employed.

Specific examples of a blowing agent employed in the method (3) are an inorganic compound such as sodium bicarbonate, ammonium bicarbonate and ammonium carbonate; a nitroso compound such as N,N-dinitrosopentamethylenetetramine, N,N'-dimethyl-N,N'-dinitrosoterephtalamide; an azo compound such as azodicarbonamide, azobisisobutyronitrile and barium azodicarboxylate; and a sufonyl hydrazide compound such as benzenesulfonyl hydrazide and toluenesulfonyl hydrazide.

The thermoplastic polymeric material used with the above blowing agent is softened by application of heat thereto and expanded by a gas generated when the blowing agent is decomposed, and eventually becomes spongy. As such a thermoplastic polymeric material, the same polymers and copolymers as those employed as the thermoplastic resin for the shell of the above-mentioned plastic filler can be used.

Among the above methods by which an intermediate layer including numerous minute voids therein is provided, the methods (2) and (3) in which the expanding is carried out by application of heat are recommendable. In particular, the method (3) in which an expandable plastic filler is expanded with application of heat is most preferable because highly close contact is attained between the thermosensitive coloring layer formed on the above intermediate layer and a thermal head due to the sufficient elasticity of the intermediate layer.

The above-mentioned intermediate layer can be formed on a support by dispersing minute void particles, minute plastic void filler particles, or a blowing agent and a thermoplastic polymeric material in water, together with a binder agent such as a conventional water-soluble polymeric material or a water-soluble emulsion thereof, coating the thus prepared dispersion on the surface of the support, and then drying. After the completion of coating and drying processes, in the case where the methods (2) and (3) are employed, a heating plate is attached to the coated intermediate layer for expanding the same. When necessary, the intermediate layer is subjected to calendering, so that the voidage of the intermediate layer can be adjusted to 50% to 95%, and the thickness thereof can be adjusted to 3 μm to 100 μm.

According to the present invention, a binder agent for use in the intermediate layer may be selected from the conventional hydrophobic polymeric emulsions and/or the water-soluble polymeric materials.

Examples of hydrophobic polymer emulsions are emulsions of styrene—butadiene copolymer latex, acrylonitrile butadiene—styrene copolymer latex, vinyl acetate resin, vinyl acetate—acrylic acid copolymer, styrene—acrylic acid ester copolymer, acrylic acid ester resin, and polyurethane resin.

Examples of water-soluble polymers are polyvinyl alcohol, starch, starch derivatives, cellulose derivatives such as methoxycellulose, hydroxyethylcellulose, carboxymethylcellulose, methylcellulose, and ethylcellulose, and other water-soluble polymers such as sodium polyacrylate, polyvinyl pyrrolidone, acrylamide—acrylic acid ester copolymer, acrylamide—acrylic acid ester—methacrylic acid copolymer, alkali salts of styrene—maleic anhydride copolymer, alkali salts of isobutylene—maleic anhydride copolymer, polyacrylamide, sodium alginate, gelatin and casein.

According to the present invention, when necessary, an undercoat layer containing a film-forming polymer, or with addition thereto of an inorganic and/or an organic filler, may be interposed between the intermediate layer and the thermosensitive coloring layer so as to make the surface of the intermediate layer uniform.

As the film-forming polymer, the above-mentioned hydrophobic emulsions or water-soluble polymeric materials employed for the formation of the intermediate layer can be used. In addition, the combination of a water-soluble polymer and a water-resisting agent may be employed.

The above water-resisting agents are such agents that condense or cross-link with the above-mentioned water-soluble polymeric materials to make the water-soluble polymeric materials resistant to water.

Examples of such water-resisting agents are formaldehyde, glyoxal, chromium alum, melamine, melamine—formaldehyde resin, polyamide resin and polyamide—epichlorohydrin resin. It is preferable that the ratio of the amount of these water-resisting agents added to the water-soluble polymeric materials be 20 to 100%.

Of the film-forming polymeric materials, emulsions of styrene—butadiene copolymer latex, polyvinylidine chloride and polyvinyl acetate are particularly preferable for use in the present invention.

As an inorganic filler and/or organic filler, one or two types of the fillers conventionally used in such a thermosensitive recording material may be selected.

Specific examples of the filler for use in the present invention are an inorganic filler such as calcium carbonate, silica, zinc oxide, titanium oxide, aluminum hydroxide, zinc hydroxide, barium sulfate, clay, talc, surface-treated calcium, and surface-treated silica, and an organic filler such as urea—formaldehyde resin, styrene—methacrylic acid copolymer, and polystyrene resin.

According to the present invention, a thermosensitive coloring layer comprising as the main components the conventional leuco dye widely used and the color developer is formed on the above-prepared intermediate layer having a foamed portion with numerous minute voids therein or the undercoat layer.

As the leuco dye for use in the present invention, which is employed alone or in combination, any conventional leuco dyes for use in conventional thermosensitive recording materials can be employed. For example, triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of those leuco dyes are as follows:
3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino) fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-(N-ethyl-N-i-amyl)amino-6-methyl-7-anilinofluoran,
3-(N-ethyl-N-tetrahydrofurfuryl)amino-6-methyl-7-anilinofluoran,
3-(N-ethyl-N-ethoxypropyl)amino-6-methyl-7-anilinofluoran,
3-(N-methyl-N-isopropyl)amino-6-methyl-7-anilinofluoran,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7-α-naphthylamino-4'-bromofluoran, and
3-diethylamino-6-methyl-7-mesidino-4',5'-benzofluoran.

As the color developers for use in combination with the above leuco dyes in the present invention, capable of inducing color formation in the leuco dyes, a variety of electron acceptors can be employed, such as phenolic materials, organic and inorganic acids, and esters and salts thereof.

Specific examples of such color developers are gallic acid, salicylic acid, 3-isopropyl salicylic acid, 3-cyclohexyl salicylic acid, 3,5-di-tert-butyl salicylic acid, 3,5-di-α-methylbenzyl salicylic acid, 4,4'-isopropylidenediphenol, 4,4'-isopropylidenebis(2-chlorophenol), 4,4'-isopropylidenebis(2,6-dibromophenol), 4,4'-isopropylidenebis (2,6-dichlorophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxy-diphenoxide, α-naphthol, β-naphthol, 3,5-xylenol, thymol, methyl-4-hydroxybenzoate, 4-hydroxyacetophenone, novolak-type phenolic resin, 2,2'-thiobis(4,6-dichlorophenol), catechol, resorcinol, hydroquinone, pyrogallol, phloroglucin, phloroglucinolcarboxylic acid, 4-tert-octylcatechol, 2,2'-methylenebis(4-chlorophenol), 2,2'-methylenebis-(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoic acid, 4-hydroxy-diphenylsulfone, 4-hydroxy-4'-chlorodiphenylsulfone, bis(4-hydroxyphenyl)sulfide, 2-hydroxy-p-toluic acid, zinc 3,5-di-tert-butylsalicylate, tin 3,5-di-tert-butyl-salicylate, tartaric acid, oxalic acid, maleic acid, citric acid, succinic acid, stearic acid, 4-hydroxy-phthalic acid, boric acid, thiourea derivatives, 4-hydroxythiophenol derivatives, bis(4-hydroxyphenyl) acetate, bis(4-hydroxyphenyl)methyl acetate, bis(4-hydroxyphenyl)ethyl acetate, bis(4-hydroxyphenyl) n-propyl acetate, bis(4-hydroxyphenyl) n-butyl acetate, bis(4-hydroxyphenyl)phenyl acetate, bis(4-hydroxyphenyl) benzyl acetate, bis(4-hydroxyphenyl) phenethyl acetate, bis(3-methyl-4-hydroxyphenyl)acetate, bis(3-methyl-4-hydroxyphenyl)methyl acetate, bis(3-methyl-4-hydroxyphenyl) ethyl acetate, bis(3-methyl-4-hydroxyphenyl) n-propyl acetate, 1,7-bis(4-hydroxyphenylthio)-3,5-dioxa-heptane, 1,5-di(4-hydroxyphenylthio)-3-oxapentane, 4-dimethyl hydroxyphthalate, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-n-propoxydiphenylsulfone, 4-hydroxy-4'-n-butoxydiphenylsulfone, 4-hydroxy-4'-isobutoxydiphenylsulfone, 4-hydroxy-4'-sec-butoxydiphenylsulfone, 4-hydroxy-4'-tert-butoxydiphenylsulfone, 4-hydroxy-4'-benzyloxydiphenylsulfone, 4-hydroxy-4'-phenoxydiphenylsulfone, 4-hydroxy-4'-(m-methylbenzyloxy)diphenylsulfone, 4-hydroxy-4'-(p-methylbenzyloxy)diphenylsulfone, 4-hydroxy-4'-(o-methylbenzyloxy) diphenylsulfone, and 4-hydroxy-4'-(p-chlorobenzyloxy) diphenylsulfone.

In the present invention, a variety of conventional binder agents can be employed for binding the above-mentioned leuco dyes and color developers to the thermosensitive coloring layer which is formed on the intermediate layer having a foamed portion with numerous minute voids therein. Specific examples of such binder agents are the same as those employed in the intermediate layer.

Further in the present invention, auxiliary additive components which are employed in the conventional thermosensitive recording materials, such as a filler, a surface active agent and a thermofusible material (or unguent), can be employed together with the above-mentioned leuco dyes and color developers.

As the filler, the same inorganic fillers and/or organic fillers as those employed in the above-mentioned undercoat layer can be used.

As the thermofusible material, for example, higher fatty acids, esters, amides and metallic salts thereof, waxes, condensation products of aromatic carboxylic acids and amines, benzoic acid phenyl esters, higher straight chain glycols, 3,4-epoxy-dialkyl hexahydrophthalate, higher ketones and other thermofusible organic compounds having melting points ranging from about 50° C. to 200° C. can be employed.

In the thermosensitive recording material for use in the present invention, a protective layer may be formed on the thermosensitive coloring layer for the purpose of improving the thermal head matching performance and increasing the preservability of recorded images. In such cases, the above-mentioned fillers, binder agents, surface active agents, and thermofusible materials may be employed as the components for the protective layer.

According to the present invention, the thermosensitive recording material can be constructed by overlaying the above-described intermediate layer having a foamed portion with numerous minute voids therein and the thermosensitive coloring layer on the support such as paper, synthetic paper, and plastic film.

The present invention will now be explained in detail by referring to the following examples.

EXAMPLE 1

[Preparation of Intermediate Layer Coating Liquid (A-1)]

A mixture of the following components was dispersed in a dispersing apparatus, whereby an intermediate layer coating liquid (A-1) was prepared:

| | Parts by Weight |
|---|---|
| Expandable plastic filler (Unexpanded) (Trademark "Matsumoto Micro Sphere F30" made by Matsumoto Yushi-Seiyaku Co., Ltd.) | 15 |
| 10% aqueous solution of polyvinyl alcohol | 30 |
| Water | 55 |

The above intermediate layer coating liquid was coated on a sheet of commercially available high quality paper in a deposition amount of 2.0 to 3.0 g/m$^2$ on dry basis in an unexpanded state, and the coated liquid was dried to form an intermediate layer. The coated surface of the intermediate layer was then brought into close contact with the surface of a rotary type drum dryer having a built-in heater, so that the intermediate layer was expanded at a surface temperature of 120° C. to 130° C. with application of heat thereto for about 2 minutes, and was then subjected to calendering, whereby a coated sheet (A-1) was prepared.

The thus prepared intermediate layer has a voidage of 91% and a thickness of 20 μm. These values were measured after completion of a thermosensitive recording sheet.

The above-mentioned voidage, expressed as a percentage, was obtained by taking a photograph of the cross section of the recording material by a scanning electron microscope, then extracting the boundaries of the solid material portions from the photograph by a commercially available image analyzer (Trademark "Luzex 5000" made by Nihon Regulator Co., Ltd.) for calculating the areas of the solid material portions, and calculating the precentage thereof.

[Prepared of Thermosensitive Coloring Layer Coating Liquid (D)]

Liquid (B) and Liquid (C) were prepared by grinding and dispersing the following respective mixtures separately in a ball mill and in an attritor until the volume mean diameter of the dispersed particles became about 1.5 μm (measured by Coulter counter):

| | Parts by Weight |
|---|---|
| Composition of Liquid (B) | |
| 3-(N-cyclohexyl-N-methyl)amino-6-methyl-7-anilinofluoran | 20 |
| 10% aqueous solution of polyvinyl alcohol | 16 |
| Water | 64 |
| Composition of Liquid (C) | |
| Benzyl p-hydroxybenzoate | 20 |
| Calcium carbonate | 10 |
| 10% aqueous solution of polyvinyl alcohol | 30 |
| Water | 40 |

A mixture of Liquid (B) and Liquid (C) with a mixing ratio of 1:4 by weight was stirred, so that a thermosensitive coloring layer coating liquid (D) was prepared.

This thermosensitive coloring layer coating liquid (D) was coated on the surface of the above-prepared coated sheet (A-1) in a deposition amount of 3.0 to 4.0 g/m$^2$ on dry basis, and the coated liquid was dried to form a thermosensitive coloring layer. The thus formed thermosensitive coloring layer was calendered, whereby a thermosensitive recording sheet No. 1 according to the present invention was prepared.

EXAMPLE 2

The same coated sheet (A-1) as that prepared in Example 1 was further calendered, so that a coated sheet (A-2) having an intermediate layer with a voidage of 60% and a thickness of 5 μm was obtained.

The same thermosensitive coloring layer coating liquid (D) as that employed in Example 1 was coated on the above intermediate layer of the coated sheet (A-2) and dried in the same manner as in Example 1. The thus formed thermosensitive coloring layer was calendered, whereby a thermosensitive recording sheet No. 2 according to the present invention was prepared.

COMPARATIVE EXAMPLE 1

A coated sheet (F-1) was prepared in the same manner as in Example 1 except that the deposition amount (2.0 g/m$^2$ to 3.0 g/m$^2$) of the intermediate layer coating liquid in Example 1 was changed to about 0.5 g/m$^2$ on dry basis and the thickness of the intermediate layer was decreased to 2 μm, with the voidage of the intermediate layer being 92%.

The same thermosensitive coloring layer coating liquid (D) as that employed in Example 1 was coated on the above-prepared coated sheet (F-1), dried and calendered in the same manner as in Example 1, whereby a comparative thermosensitive recording sheet No. 1 was prepared.

COMPARATIVE EXAMPLE 2

The same coated sheet (A-1) as that prepared in Example 1 was further calendered, so that a coated sheet (F-2) having an intermediate layer with a voidage of 40% and a thickness of 3.5 μm was obtained.

The same thermosensitive coloring layer coating liquid (D) as that employed in Example 1 was coated on the above intermediate layer of the coated sheet (A-2) and dried in the same manner as in Example 1. The thus formed thermosensitive coloring layer was calendered, whereby a comparative thermosensitive recording sheet No. 2 was prepared.

EXAMPLE 3

[Preparation of Intermediate Layer Coating Liquid (A-2)]

A mixture of the following components was dispersed in a dispersing apparatus, whereby an intermediate layer coating liquid (A-2) was prepared:

| | Parts by Weight |
|---|---|
| Minute void particles (Trademark "Expancel DE (#551)" made by Nippon Ferrite Co., Ltd.) | 15 |
| 10% aqueous solution of polyvinyl alcohol | 15 |
| Water | 70 |

The above intermediate layer coating liquid was coated on a sheet of commercially available high quality paper in a deposition amount of about 3.0 g/m$^2$ on dry basis in an unexpanded state, and the coated liquid was dried to form an intermediate layer. The thus formed intermediate layer was then subjected to calendering, whereby a coated sheet (A-3) was prepared.

The thus prepared intermediate layer has a voidage of 82% and a thickness of 10 μm.

The same thermosensitive coloring layer coating liquid (D) as that employed in Example 1 was coated on the above-prepared coated sheet (A-3) and dried in the same manner as employed in Example 1. The thus formed thermosensitive coloring layer was calendered, whereby a thermosensitive recording sheet No. 3 according to the present invention was prepared.

COMPARATIVE EXAMPLE 3

A mixture of the following compositions was dispersed in a dispersing apparatus, whereby an intermediate layer coating liquid was prepared:

| | Parts by Weight |
|---|---|
| Finely-divided silica particles | 20 |
| 10% aqueous solution of polyvinyl alcohol | 20 |
| Water | 60 |

The above intermediate layer coating liquid was coated on a sheet of commercially available high quality paper in a deposition amount of about 4.0 g/m$^2$ on dry basis and then dried. The thus prepared intermediate layer was calendered to form a coated sheet (F-3).

The intermediate layer had a voidage of 15% and a thickness of 5 μm.

The same thermosensitive coloring layer coating liquid (D) as that employed in Example 1 was coated onto the above-prepared coated sheet (F-3) and dried in the same manner as in Example 1. The thus formed thermosensitive coloring layer was calendered, whereby a comparative thermosensitive recording sheet No. 3 was prepared.

The thermosensitive recording sheets No. 1 through No. 3 according to the present invention and the comparative thermosensitive recording sheets No. 1 through No. 3 were subjected to dynamic thermal coloring sensitivity tests by use of a G-III facsimile test apparatus, and the image densities of the formed images were measured by use of a Macbeth densitometer RD-514 with a filter Wratten-106 attached thereto.

More specifically the dynamic thermal coloring sensitivity tests were conducted by performing thermal printing on each of the above thermosensitive recording sheets by a G-III facsimile test apparatus having an 8 dots/mm thermal head (commercially available by Matsushita Electronic Components Co., Ltd.) including a heat generating resistor of about 400 Ω/dot, under the conditions that the main scanning recording speed was 20 msec/line, the sub-scanning density was 3.85 line/mm, the pressure application by a platen was 1.4 kg/cm$^2$, and the electric power applied to the thermal head was 0.4 W/dot, with the electric power application time changed to 1.0 msec, 1.4 msec, and 1.8 msec. The results are shown in Table 1.

TABLE 1

| Example No. | Thermosensitive Recording Sheet | Intermediate Layer Voidage (%) | Intermediate Layer Thickness (μm) | Dynamic Thermal Coloring Sensitivity 1.0 (msec.) | 1.4 (msec.) | 1.8 (msec.) |
|---|---|---|---|---|---|---|
| Example 1 | No. 1 | 91 | 20 | 1.03 | 1.33 | 1.40 |
| Example 2 | No. 2 | 60 | 5 | 1.01 | 1.30 | 1.38 |
| Example 3 | No. 3 | 82 | 10 | 0.95 | 1.27 | 1.35 |
| Comparative Example 1 | No. 1 | 92 | 2 | 0.80 | 0.99 | 1.21 |
| Comparative Example 2 | No. 2 | 40 | 3.5 | 0.75 | 1.00 | 1.25 |
| Comparative Example 3 | No. 3 | 15 | 5 | 0.60 | 0.89 | 1.15 |

As shown in Table 1, thermosensitive recording sheets according to the present invention can produce sharp images with high dynamic thermal coloring sensitivity at a small amount of thermal energy.

What is claimed is:

1. A thermosensitive recording material comprising a support, an intermediate layer having a voidage ranging from 50% to 95% and a thickness of 3 μm to 100 μm formed on said support, and a thermosensitive coloring layer formed on said intermediate layer.

2. The thermosensitive recording material as claimed in claim 1, wherein said intermediate layer has a thickness ranging from 3 μm to 50 μm.

3. The thermosensitive recording material as claimed in claim 1, wherein said intermediate layer has a thickness ranging from 5 μm to 30 μm.

4. The thermosensitive recording material as claimed in claim 1, wherein said thermosensitive coloring layer comprises a leuco dye and a color developer capable of inducing color formation in said leuco dye upon application of heat thereto.

* * * * *

UNITED STATES PATENT AND TRADEMARK OFFICE

CERTIFICATE OF CORRECTION

PATENT NO. : 4,912,079

DATED : March 27, 1990

INVENTOR(S) : Kawasaki et al.

It is certified that error appears in the above-identified patent and that said Letters Patent is hereby corrected as shown below:

Column 3, line 54, "above mentioned" should read --above-mentioned--.

Column 3, line 65, "comes" should read --come--.

Column 4, line 60, "heat the" should read --heat to the--.

Column 8, line 38, "butylsalicylate" should read --butyl-salicylate--.

Column 12, line 19, after "More specifically" insert --,--.

Signed and Sealed this

Twentieth Day of August, 1991

*Attest:*

*Attesting Officer*

HARRY F. MANBECK, JR.

*Commissioner of Patents and Trademarks*